United States Patent [19]

Sköld et al.

[11] Patent Number: 4,976,919

[45] Date of Patent: Dec. 11, 1990

[54] METHOD FOR MECHANICALLY WORKING COBALT-CONTAINING METAL

[75] Inventors: Rolf Sköld; Irene Johansson, both of Stenungsund, Sweden

[73] Assignee: Berol Kemi AB, Stenungsund, Sweden

[21] Appl. No.: 164,466

[22] Filed: Mar. 4, 1988

Related U.S. Application Data

[63] Continuation-in-part of Ser. No. 792,597, Oct. 29, 1985.

[30] Foreign Application Priority Data

Oct. 30, 1984 [SE] Sweden ..... 8405422-0

[51] Int. Cl.[5] ..... C23F 11/00; C10M 103/00; C10M 133/00

[52] U.S. Cl. ..... 422/7; 422/16; 252/49.3; 252/51.5 R

[58] Field of Search ..... 422/7, 16; 252/49.3, 252/51.5 R, 403

[56] References Cited

U.S. PATENT DOCUMENTS

| | | | |
|---|---|---|---|
| 2,917,160 | 12/1959 | Turinsky | 252/51.5 R |
| 2,999,064 | 9/1961 | Sluhan | 252/49.3 |
| 3,123,634 | 3/1964 | Udelhofer | 422/7 |
| 3,280,029 | 10/1966 | Waldmann | 422/7 |
| 3,719,598 | 3/1973 | King | 252/49.3 |
| 4,177,155 | 12/1979 | Popplewell et al. | 252/49.3 |
| 4,243,537 | 1/1981 | Knepp et al. | 252/49.3 |
| 4,303,540 | 12/1981 | Schuster | 252/49.3 |
| 4,315,889 | 2/1982 | McCheeney et al. | 422/7 |
| 4,452,711 | 6/1984 | Laemmle | 252/49.3 |
| 4,564,461 | 1/1986 | Sköld et al. | 252/49.3 |
| 4,828,737 | 5/1989 | Sandberg et al. | 252/49.3 |

FOREIGN PATENT DOCUMENTS 0068061 1/1983 European Pat. Off. .

OTHER PUBLICATIONS

Mosher, E. et al.; "The Chemical Control of Robalt Leaching from Cemented Carbide Tooling", *Materials Performance,* vol. 25, Oct., 1986, pp. 38–43.

*Primary Examiner*—Robert J. Warden
*Assistant Examiner*—Thalia P. Vassilatos
*Attorney, Agent, or Firm*—Spencer & Frank

[57] ABSTRACT

A method for mechanically working cobalt-containing metals is carried out in the presence of a synthetic metal working liquid containing specific tertiary amines which are alkanol amines capable of reducing both the release of cobalt and the corrosion of iron. The alkanol amine compounds contain one or more hydrophobic groups, such as alkyl groups or higher alkylene oxy groups. A concentrate is provided which contains the alkanol amine compounds and which is suitable, after dilution with water, for use in mechanical working.

24 Claims, No Drawings

METHOD FOR MECHANICALLY WORKING COBALT-CONTAINING METAL

This Application is a Continuation-In-Part Application of Ser. No. 06/792,597 filed Oct. 29th, 1985.

BACKGROUND OF THE INVENTION

1. Field of the Invention

The present invention relates to a synthetic metal working liquid, concentrate thereof, and method for mechanically working cobalt-containing metals. The concentrate is suitable, after dilution with water to provide the synthetic metal working liquid, for use in the mechanical working method. The method is carried out with the synthetic metal working liquid which is comprised of specific tertiary amines which are alkanol amines capable of reducing both the release of cobalt ions and the corrosion of iron.

2. Discussion of the Art

The mechanical working of hard metals, i.e., cemented carbides containing cobalt, by, for example, grinding the cobalt-containing hard metals, is usually carried out in the presence of a metal working liquid also known as an aqueous cooling lubricant. The aqueous cooling lubricant contains a lubricant, such as a fatty acid salt, and frequently contains iron corrosion inhibitors, such as salts of triethanol amine. During mechanical working, a large quantity of chips are produced having a large surface area which, when exposed to the aqueous cooling lubricant, participate in corrosion processes, whereby the content of ionic cobalt in solution in the aqueous cooling lubricant will reach high levels. Frequently, the cobalt concentration amounts to several hundreds of milligrams per liter of cooling lubricant.

Besides the negative effect which the corrosion processes have on the appearance and dimensional tolerances of the metal surface, ionic cobalt constitutes a serious health hazard to human beings who come into contact therewith by touch or via airborne aerosol. Ionic cobalt is a strong allergen for man. One way of reducing the content of ionic cobalt in recirculating cooling systems is to filter the cooling lubricant; another way is to make frequent changes of cooling lubricant, simultaneously as tanks and machines are thoroughly cleaned.

U.S. Pat. No. 4,315,889 to J. M. McChesney et al. describes a method of reducing leaching of cobalt from metal working tools containing tungsten carbide particles bonded by cobalt. According to this Patent, metal working is carried out in the presence of metal working compositions containing, as the active component, a specific triazole or thiadiazole compound. The compositions may be water-based, oil-in-water emulsions or oil-based. The aqueous coolant and lubricant metal working composition further comprises boric acid, an amine or mixture of amines, sodium gluconate, and an aromatic or paraffinic carboxylic acid. The amine or mixture of amines react with the boric acid and organic carboxylic acid components of the composition to form salts. The amine component can be a secondary or tertiary amine with sufficient reactivity, such as di- or triethanolamine, triisopropanol amine and 2-dimethylamino, 2-methyl, 1-propanol amine.

U.S. Pat. No. 3,280,029 to H. F. Waldmann describes a lubricant composition for reducing vapor phase corrosion and metal fatigue. Certain secondary or tertiary amines which are alkyl amino monoalkanols are incorporated into the lubricant and have the general formula

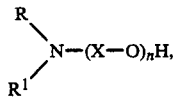

where R represents an alkyl group, $R^1$ represents an alkyl group the same or different from R, or a hydrogen atom, R and $R^1$ are selected so that the sum of the groups represented by $R+R^1$ does not exceed 10 carbon atoms, X is an alkylene group having from 2 to about 4 carbon atoms, and n is 1 or 2. The lubricant composition may be a lubricating oil or a water-in-oil emulsion having from 10 to 70% by weight of water. The alkyl amino monoalkanols must be present in an effective state so that they are free to act in the lubricant composition, that is, they should not be tied up as reaction products with other components.

SUMMARY OF THE INVENTION

It is an object of the present invention, to substantially reduce the release of cobalt and simultaneously to maintain the corrosion of iron at a very low level during the mechanical working of cobalt-containing metals.

This object is accomplished by working the cobalt-containing metal in the presence of an aqueous and alkaline (pH above 7) composition comprised of at least 85% water and specific tertiary amines which are mono-, di-, or trialkanol amines. These tertiary alkanol amine compounds always contain a hydrophobic group.

The method for reducing corrosion and reducing the release of cobalt into solution and corrosion while mechanically working cobalt-containing metals includes working the cobalt-containing metals in the presence of a synthetic metal working liquid which is aqueous and alkaline, is comprised of at least 85% water and, as a cobalt release- and corrosion-inhibiting agent, at least one tertiary alkanol amine selected from the group consisting of tertiary alkanol amines having the formulas:

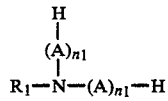

I wherein A is an alkylene oxy group derived from an alkylene oxide having 2–4 carbon atoms, $R_1$ is an alkyl group having 1–5 carbon atoms or the group $(A)_n$-H, $n_1$ is an integer ranging from 1 to 6, and a ratio of the number of groups derived from ethylene oxide to the total number of groups derived from alkylene oxide ranges from 1:15 to 1:2; and

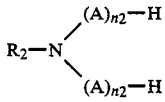

II wherein $R_2$ is a hydrocarbon group having 6–18 carbon atoms, A is an alkylene oxide group derived from an alkylene oxide having 2–4 carbon atoms, and $n_2$ is an integer ranging from 1 to 5.

Preferably the synthetic metal working liquid is an aqueous solution and essentially free from emulsified oil.

Alternately, the method for reducing corrosion and reducing the release of cobalt into solution while mechanically working cobalt-containing metals includes working the cobalt-containing metals in the presence of a synthetic metal working liquid which is an alkaline, aqueous solution and is comprised of at least 85% by weight water and, as a cobalt release- and corrosion-inhibiting agent, at least one tertiary alkanol amine having the formula:

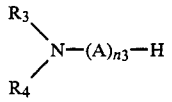

III wherein $R_3$ and $R_4$ represent hydrocarbon groups having carbon atoms, or together with the nitrogen atom, form a six-membered ring which, in addition to carbon atoms, may also contain an oxygen atom, A represents an alkylene oxy group derived from an alkylene oxide having 2–4 carbon atoms, and $n_3$ is an integer ranging from 1 to 10, preferably from 2 to 8.

A concentrate which is preferably in the form of a solution and is suitable as a synthetic metal working liquid after dilution thereof with water to contain from 85 to 99% by weight water for use in the mechanical working of cobalt-containing metals for reducing corrosion and reducing the release of cobalt into solution in the synthetic metal working liquid includes from 1 to 70% by weight of at least one tertiary alkanol amine selected from the group consisting of tertiary alkanol amines having the formulas I, II and III previously given; from 0–50% by weight of at least one supplementary corrosion protection agent; from 0–50% by weight of at least one lubricant; from 0–20% by weight of at least one additive selected from the group consisting of pH-controlling agents, bactericidal agents, solubility promoters, perfumes and viscosity controlling agents; and from 5–70% by weight water.

The metal working liquid further comprises from a finite amount up to 10% by weight of at least one supplemental corrosion inhibiting agent which is at least on of boric acid or an organic carboxylic acid having less than 10 carbon atoms. The tertiary monoalkanol amines of formula I, II, and III react with the at least one supplementary corrosion inhibiting agent to form a salt.

DESCRIPTION OF THE PREFERRED EMBODIMENTS

As will appear from the above formulae, the tertiary alkanol amine compounds will always contain one or more hydrophobic groups, such as alkyl groups or higher alkylene oxy groups. The presence of these hydrophobic groups is of essential importance to the reduction of both the release of cobalt and the corrosion of iron. Particularly suitable tertiary alkanol amine compounds are compounds of formula I showing a ratio of the number of groups derived from ethylene oxide to the total number of groups derived from alkylene oxide of from 1:10 to 1:3, compounds of formula II containing both ethylene oxy and higher alkylene oxy groups, and compounds of formula III wherein $R_3$ and $R_4$ are alkyl groups having a total sum of from 5 to 10 carbon atoms or a six-membered ring, and $n_3$ is an integer from 2 to 8. The content of tertiary alkanol amine ranges from 0.01 to 50% by weight, preferably from 0.01 to 15% by weight, and most preferably from 0.2 to 3% by weight based the weight of the metal working liquid.

The above-mentioned tertiary alkanol amines can advantageously be combined with organic carboxylic acids, preferably having up to 10 carbon atoms, such as azelaic acid, sulphonamido carboxylic acid, pelargonic acid and isononanoic acid, or inorganic acids, such as boric acid, whereby the protection against the release of cobalt and the corrosion of iron will be further improved. The tertiary alkanol amines may advantageously react with these supplementary corrosion inhibiting agents to form a salt. The protection may be still further improved by adding compounds of the type triazole or thiadiazole. The content of these supplementary corrosion protection components, especially those in the form of organic carboxylic acids, range from a finite amount up to 10% by weight, preferably from 0.1 to 2% by weight.

To reduce the friction of the cooling lubricant, conventional lubricants may be added, provided that the lubricants do not form emulsions and do not corrode either cobalt or iron. Examples of suitable lubricants are monocarboxylic acids, preferably having more than 10 carbon atoms, such as fatty acids having 12–18 carbon atoms, and/or nonionic alkylene oxide adducts having a molecular weight of more than 400, such as polypropylene glycol or random-added polypropylene polyethylene glycols, or block copolymers of ethylene and propylene oxide. The anionic lubricants are also capable of protecting iron against corrosion. The content of lubricant in the cooling lubricant may range from a finite amount up to 10% by weight, preferably from 0.05–2.0% by weight.

Besides corrosion inhibitors and lubricants, the inventive cooling lubricant preferably and in a per se known manner may contain pH-controlling agents, bactericidal agents, perfumes, viscosity-controlling agents and solubility-improving agents. The solubility-improving agents usually are low-molecular weight hydroxyl-containing compounds, such as propylene glycol, ethylene diglycol, butyl diethylene glycol, or glycerol.

For preparing the cooling lubricant according to the present invention, it is preferred first to prepare a concentrate, preferably by adding to a suitable amount of water, the tertiary alkanol amine and then the remaining components. The amount of water in relation to the remaining components is preferably selected so that a water content of about 10–70% by weight of the concentrate is obtained. A typical concentrate formulation according to the present invention is thus: tertiary alkanol amine, 1–70, preferably 5–50% by weight; supplementary corrosion protection agent, 0–50, preferably 2–30% by weight; lubricant, 0–50, preferably 1–30% by weight; pH-controlling bactericidal agent, solubility promoter etc., 0–20, preferably 0–15% by weight; and water, 5–70, preferably 15–50% by weight.

Before the concentrate is used, it is diluted with water so that the synthetic metal working liquid will have a water content of from 85% to 99% by weight.

To illustrate the present invention, the following Examples are given.

EXAMPLE 1

A number of compositions were prepared by adding to water 0.75% by weight of a corrosion protection agent in accordance with Table I which follows, and acetic acid in an amount such that the pH was 9.2. The acetic acid formed a salt with the corrosion protection agent. The tendency of the compositions to release cobalt was measured by shaking a vessel containing 100 ml of the composition together with 50 mg of cobalt powder having a surface area of 1.2 $m^2/g$ at room temperature for five days. After that, the content of cobalt in solution was measured by means of atomic absorption spectrophotometry. The iron corrosion was determined by applying 1.25 g of the compositions to a filter paper coated with cast-iron chips and determining, after 24 hours, the size of the surface covered with rust. A comparison test with water was also carried out.

TABLE I

| Test | Corrosion protection agent | Cobolt released amount mg/l | Iron corrsion, % of surface coated with rust |
|---|---|---|---|
| A | Triethanol amine + 6 PO* | 0.4 | 12 |
| B | Cyclohexyl diethanol amine | 0.3 | 14 |
| C | Morpholine + 2PO* | <0.1 | 8 |
| D | Dimethyl ethanol amine | 0.6 | 13 |
| E | Dipropyl ethanol amine | 0.2 | 15 |
| F | 2-amino-2-methylpropanol + 3PO* | 0.3 | 10 |
| G | 2-(N,N-dimethylamino)-2-methylpropanol | 0.2 | 9 |
| H | Triethanol amine | 300 | 5 |
| I | Triisopropanol amine | 280 | 8 |
| J | Pentyl diethanol amine | 170 | 14 |
| K | — | 15 | 100 |
| L | | <1 | |
| M | Ethylmonoethanolamine | 12 | |
| N | Butylmonoethanolamine | 23 | |
| O | Methylethanolamine | 173 | |

*PO = propylene oxide

The results show that compositions A-G according to the invention are far superior to comparative compositions H-J employing amines optionally taught by the previously discussed McChesney et al. reference and give both low corrosion of iron and low release of cobalt. Test K is a test in water having a hardness of about 10° dH. Similarly, the results show that compositions A-G according to the invention are far superior to comparative compositions M-O employing amines according to the previously discussed Waldmann reference and give low release of cobalt. Test L is a test in deionized water.

EXAMPLE 2

A concentrate was prepared by adding to 150 g of water, 600 g of an alkylene oxide adduct obtained by causing 1 mole of morpholine to react with 2 moles of propylene oxide, and then 200 g of azelaic acid and 50 g of polypropylene glycol having a molecular weight of 2000. The azelaic acid formed a salt with the detained morphorine propylene oride adduct. The concentrate was then diluted with water to 40 times its own weight, and the pH was adjusted to 9.0 by means of lye. The tendency of the compositions to release cobalt and corrode iron was tested in the same manner as in Example 1. The cobalt content was 0.2 mg/1, while 0% of the surface of the filter paper was coated with rust. For comparison, the same composition was tested in the presence of triethanol amine (an amine optionally employed by the previously discussed McChesney et al. reference) as the amine compound, instead of the morpholine adduct. The corresponding values were 150 mg/l and 0%.

The above-mentioned compositions were also tested as cooling liquids in a grinding machine working cobalt-containing hard metals for three days. The composition containing the morpholine adduct contained after three days a noticeably lower amount of released cobalt than the composition containing triethanol amine. The results obtained were comparable to the above-mentioned laboratory test reported in Table I.

The present disclosure relates to the subject matter disclosed in Swedish Patent Application Serial No. 8405422-0 filed Oct. 30th, 1984, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A method for reducing corrosion and reducing the release of cobalt into solution while mechanically working cobalt-containing metals, the method comprising:

working said cobalt-containing metals in the presence of a synthetic metal working liquid which is aqueous and alkaline, is comprised of at least 85% water and, as a cobalt release- and corrosion-inhibiting agent, at least one tertiary alkanol amine selected from the group consisting of tertiary alkanol amines having the formulas:

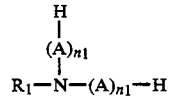

I wherein:

A is an alkylene oxy group derived from an alkylene oxide having 2–4 carbon atoms, $R_1$ is an alkyl group having 1–5 carbon atoms or the group $(A)_n$-H, $n_1$ is an integer ranging from 1 to 6, and a ratio of the number of groups derived from ethylene oxide to the total number of groups derived from alkylene oxide ranges from 1:15 to 1:2; and

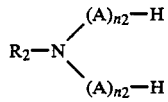

II wherein:

$R_2$ is a hydrocarbon group having 6–18 carbon atoms,

A is an alkylene oxide group derived from an alkylene oxide having 2–4 carbon atoms, and $n_2$ is an integer ranging from 1 to 5.

2. The method according to claim 1, wherein the synthetic metal working liquid is an aqueous solution.

3. The method according to claim 1, wherein, in the compounds of formula I, said ratio of the number of groups derived from ethylene oxide to the total number of groups derived from alkylene oxide ranges from 1:10 to 1:3 and wherein the compounds of formula II contain both ethylene oxy and higher alkylene oxy groups.

4. The method according to claim 1, wherein the amount of said at least one tertiary alkanol amine in said synthetic metal working liquid ranges from 0.01 to 15% by weight.

5. The method according to claim 4, wherein the amount of said at least one tertiary alkanol amine in said synthetic metal working liquid ranges from 0.2 to 3% by weight.

6. The method according to claim 1, wherein said synthetic metal working liquid further comprises from a finite amount up to 10% by weight of at least one supplementary corrosion inhibiting agent.

7. The method according to claim 6, wherein the at least one supplementary corrosion inhibiting agent is at least one of boric acid and an organic carboxylic acid having less than 10 carbon atoms.

8. The method according to claim 7, wherein the at least one supplementary corrosion inhibiting agent is at least one organic carboxylic acid having less than 10 carbon atoms present in an amount ranging from 0.1 to 2% by weight.

9. The method according to claim 1, wherein said synthetic metal working liquid further comprises from a finite amount up to 10% by weight of a lubricant.

10. The method according to claim 9, wherein said lubricant is selected from the group consisting of monocarboxylic acids having more than 10 carbon atoms and nonionic alkylene oxide adducts having molecular weights of more than 400.

11. The method according to claim 10, wherein said lubricant is present in an amount ranging from 0.05 to 10% by weight.

12. The method according to claim 11, wherein said lubricant is present in an amount ranging from 0.05 to 2% by weight.

13. A method for reducing corrosion and reducing the release of cobalt into solution while mechanically working cobalt-containing metals, the method comprising:

working said cobalt-containing metals in the presence of a synthetic metal working liquid which is an alkaline, aqueous solution and is comprised of at least 85% by weight water and, as a cobalt release- and corrosion-inhibiting agent, at least one tertiary alkanol amine having the formula:

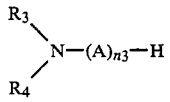

III wherein:

$R_3$ and $R_4$ represent hydrocarbon groups having carbon atoms, or together with the nitrogen atom, form a six-membered ring which contains at least one of carbon atoms and an oxygen atom, A represents an alkylene oxy group derived from an alkylene oxide having 2–4 carbon atoms, and $n_3$ is an integer ranging from 1 to 10.

14. The method according to claim 13, wherein the synthetic metal working fluid is essentially free from emulsified oil.

15. The method according to claim 13, wherein $R_3$ and $R_4$ are alkyl groups having a total of from 5 to 10 carbon atoms or a six-membered ring.

16. The method according to claim 13, wherein said synthetic metal working liquid further comprises from a finite amount up to 10% by weight of at least one supplementary corrosion inhibiting agent which is at least one of boric acid and an organic carboxylic acid having less than 10 carbon atoms.

17. The method according to claim 16, wherein said at least one tertiary alkanol amine and said at least one supplementary corrosion inhibiting agent react to form a salt.

18. The method according to claim 13, wherein said synthetic metal working liquid further comprises from a finite amount to 10% by weight of a lubricant selected from the group consisting of monocarboxylic acids having more than 10 carbon atoms and nonionic alkylene oxide adducts having molecular weights of more than 400.

19. A method for reducing corrosion and reducing the release of cobalt into solution while mechanically working cobalt-containing metals, the method comprising:

working said cobalt-containing metals in the presence of a synthetic metal working liquid which is aqueous and alkaline, and is comprised of at least 85% by weight water and, as a cobalt release- and corrosion-inhibiting agent, at least one tertiary alkanol amine having the formula:

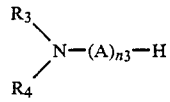

III wherein:

$R_3$ and $R_4$ represent hydrocarbon groups having carbon atoms which form a six-membered ring with at least one of (a) the nitrogen atom and (b) the nitrogen atom and, which six-membered ring may also contain an oxygen atom, A represents an alkylene oxy group derived from an alkylene oxide having 2–4 carbon atoms, and $n_3$ is an integer ranging from 1 to 10.

20. The method according to claim 19, wherein the synthetic metal working fluid is a solution.

21. The method according to claim 19, wherein $R_3$ and $R_4$ are a ring group having a total of from 5 to 10 carbon atoms.

22. The method according to claim 19, wherein said synthetic metal working liquid further comprises from a finite amount up to 10% by weight of at least one supplementary corrosion inhibiting agent which is at least one of boric acid and an organic carboxylic acid having less than 10 carbon atoms.

23. The method according to claim 22, wherein said at least one tertiary alkanol amine and said at least one supplementary corrosion inhibiting agent react to form a salt.

24. The method according to claim 19, wherein said synthetic metal working liquid further comprises from a finite amount to 10% by weight of a lubricant selected from the group consisting of monocarboxylic acids having more than 10 carbon atoms and nonionic alkylene oxide adducts having molecular weights of more than 400.

* * * * *